United States Patent [19]

Rosar et al.

[11] Patent Number: 4,800,348

[45] Date of Patent: Jan. 24, 1989

[54] ADJUSTABLE ELECTRONIC FILTER AND METHOD OF TUNING SAME

[75] Inventors: George C. Rosar, Waseca, Minn.; David G. Clifford, Jr., Albuquerque, N. Mex.

[73] Assignee: Motorola, Inc., Schaumburg, Ill.

[21] Appl. No.: 81,264

[22] Filed: Aug. 3, 1987

[51] Int. Cl.[4] ..... H01P 1/205; H01P 7/04

[52] U.S. Cl. ..... 333/202; 333/206; 333/207; 333/222; 333/223

[58] Field of Search ..... 333/202, 203, 206, 207, 333/223, 235, 219, 222

[56] References Cited

U.S. PATENT DOCUMENTS

| | | | |
|---|---|---|---|
| 4,157,517 | 6/1979 | Kneisel et al. | 333/205 |
| 4,426,631 | 1/1984 | D'Avello et al. | 333/222 X |
| 4,431,977 | 2/1984 | Sokola et al. | 333/206 |
| 4,506,241 | 3/1985 | Makimoto et al. | 333/222 |
| 4,523,162 | 6/1985 | Johnson | 333/202 |

*Primary Examiner*—Marvin L. Nussbaum
*Attorney, Agent, or Firm*—Charles L. Warren

[57] ABSTRACT

An adjustable electronic filter apparatus is disclosed comprising a dielectric block having one or more through-holes and having a conformal conductive coating substantially over all outside surfaces as well as each through-hole therein. Each through-hole so plated forms a resonator from a transmission line which includes an open portion, for providing capacitive reactance at a first end, and a short-circuited end as a base, for providing an associated distributed inductance at a second end thereof. A unique method of tuning the adjustable electronic filter, whether a single resonator, a plurality of resonators, or a plurality of intercoupled multi-resonator filters, is disclosed that permits bi-directional tuning for at least one resonator in each of the above exemplary embodiments. By selectively adjusting an inductive portion of the plating at the base of each resonator so tuned, a resonator is quickly and accurately adjusted to a desired frequency. The selective adjusting may be accomplished by subtractive processes, such as abrasion or laser trimming, or by an additive process, such as by adding conductive paint for partially filling in a removed or absent portion of the plating at the base of a resonator.

19 Claims, 3 Drawing Sheets

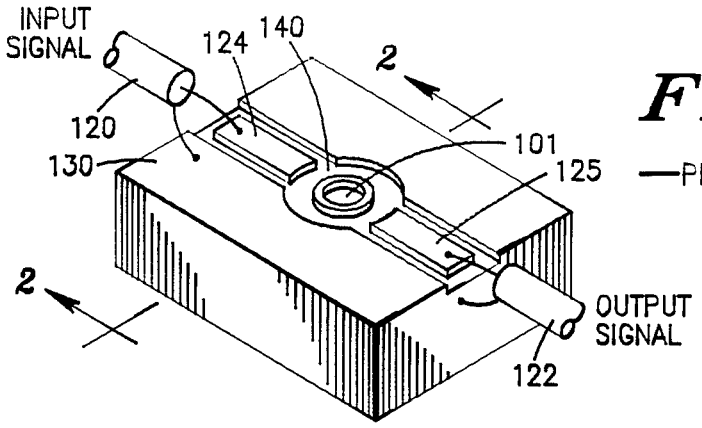
FIG. 1
—PRIOR ART—
FIG. 2
—PRIOR ART—
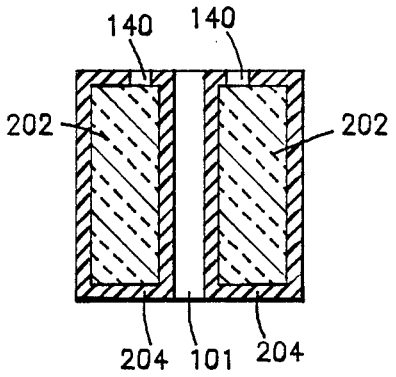
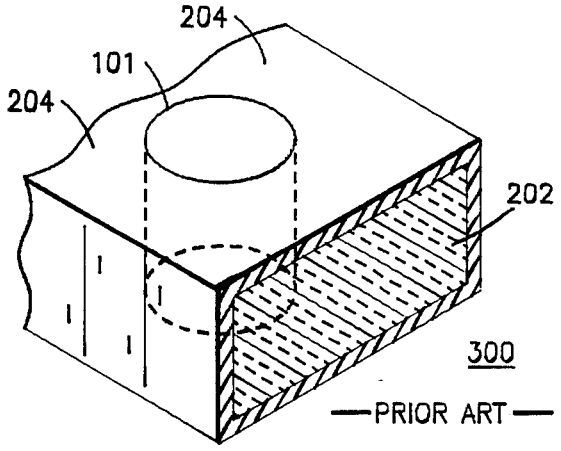
—PRIOR ART—
FIG. 3
FIG. 4B
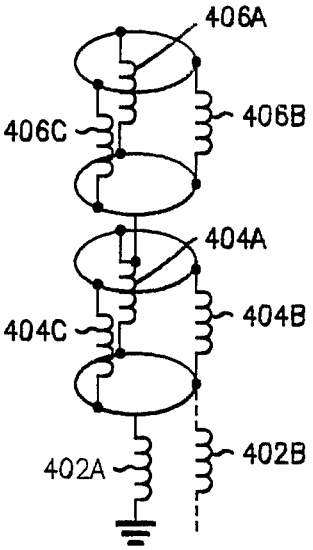
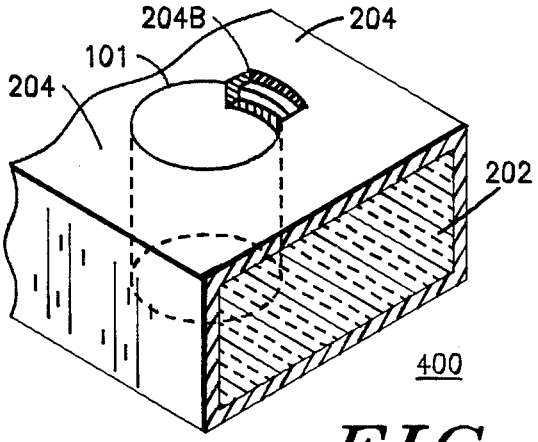
FIG. 4A

ADJUSTABLE ELECTRONIC FILTER AND METHOD OF TUNING SAME

BACKGROUND OF THE INVENTION

The present invention is related generally to radio frequency (RF) electronic filters, and more particularly to an improved adjustable ceramic filter and method of tuning that is particularly well adapted for use in radio transmitting and receiving equipment.

Many structures for multi-resonator filters are known. One such structure includes ceramic filters comprised of a dielectric block having one or more holes extending from its top surface to its bottom surface and further having first and second electrodes each disposed on the dielectric block at a pre-determined distance from a corresponding hole. If there is only one hole in the dielectric block, the first and second electrodes may be arranged around that hole. If there are two or more holes in the dielectric block, the first electrode may be located near the hole at one end of the dielectric block and the second electrode may be located near the hole at the opposite end of the dielectric block. A conformal conductive coating, or plating, covers essentially the entire surface of the dielectric block, including each through-hole, for forming a transmission line which has an open portion in the plating to provide a resonator by including capacitive reactance thereat and except for portions near included first and second electrodes. Coupling between resonators is controlled by included conductive slots between resonators, or merely by the spacing between resonators being set to a predetermined distance.

Each resonator is generally set at a frequency lower than a desired frequency, and then subsequently tuned by removing capacitive portions of the conductive coating from each resonator in a pre-established tuning sequence, usually accomplished by the removal of additional ground plating near the top, capacitive region, of each plated hole while monitoring the return loss angle of the filter. This tuning process is implemented by initially grounding the plating at the top of each plated hole and then measuring an initial value of the return loss angle. Then, with the ground to each plated hole removed one at a time, the ground plating near the top of that plated hole is trimmed or selectively removed, until a phase target of 180 degrees of phase shift is achieved. The ground provided to each plated through-hole can be done manually by means of a metallic instrument, or by means of including a small plating runner that bridges the unplated area, or capacitive region, between the plated through-hole and the surrounding conformal plating on the dielectric block.

However, due to the subtractive tuning process just described, the above structure and tuning method suffers from several serious drawbacks. The first is that removal of relatively small selected portions of the conductive coating near the top of each resonator can cause relatively large upward frequency shifts. Thus, if too much conductive material is removed, the phase target can be missed and the resonator will be tuned at a frequency much higher than the desired resonant frequency. The second drawback is that such a tuning method only provides uni-directional tuning.

Although one known method of restoring an over-tuned resonator back down to its desired resonant frequency includes the use of conductive paint, such a process consumes additional time and must be done carefully to insure that the resonator ultimately operates at its desired frequency. The additional steps involved in utilizing such a method are to be avoided, particularly when constructing and tuning large volumes of such ceramic filters. Clearly, what is needed is a new method of tuning, utilizing the preferred subtractive process, such that bi-directional tuning is possible. This new method should, therefore, be able to provide real-time, on-line adjustment of one or more resonators in a ceramic filter, in order to reduce overall production time and cost incurred during construction and tuning.

SUMMARY OF THE INVENTION

Accordingly, it is an object of the present invention to provide an improved, adjustable electronic filter and method of tuning which overcomes the foregoing deficiencies.

It is a further object of the present invention to provide an improved, adjutable electronic filter and method of tuning of the foregoing type which permits bi-directional tuning of the filter, especially when utilizing a subtractive adjustment process as the preferred process.

In practicing one form of the invention, an electronic filter comprised of a dielectric block having one or more through-holes with first and second ends includes a conformal conductive coating applied over all outside surfaces as well as each through-hole therein, to form at least one transmission line in which an open portion completely surrounding a first end of each through-hole is included for forming a resonator by having capacitive reactance thereat and with the conformal conductive coating subsequently adjusted either by adding or removing inductive portions of the conductive coating depending on whether an incremental decrease or increase in the inductance of at least one resonator is needed.

In practicing another form of the present invention, an electronic filter having at least two resonators formed within a dielectric block having two through-holes spacially separated at a predetermined distance from one another and the dielectric block and the holes having a conformal conductive coating, is tuned via a tuning method including the step of selectively adjusting inductive portions of the conductive coating from the base of at least one resonator in addition to the conventional step of selectively removing capacitive portions of the conductive coating from the top of each resonator in a pre-established tuning sequence and then repeating the steps a number of times sufficient to incrementally tune the electronic filter to a desired accuracy so as to permit bi-directional tuning of the filter.

BRIEF DESCRIPTION OF THE DRAWINGS

FIG. 1 is a top perspective view of a single resonator formed within a dielectric block according to the prior art.

FIG. 2 is a cross section of the prior art resonator in FIG. 1 taken along lines 2—2.

FIG. 3 is a bottom perspective view of the resonator formed in a dielectric block according to the prior art.

FIG. 4A is a bottom perspective view of a resonator formed in a dielectric block having an inductive portion of the conductive coating modified according to the present invention.

FIG. 4B is a schematic representation of the distributed inductance represented by the plated through-hole of the resonator depicted in FIG. 4A.

DETAILED DESCRIPTION OF THE PREFERRED EMBODIMENT

Figure 7:
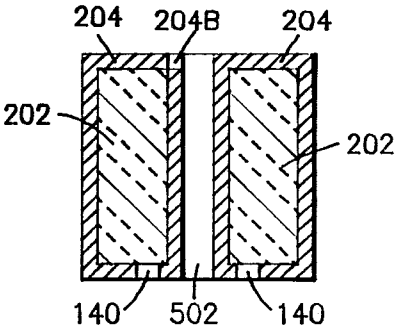
FIG. 7 is a cross sectional view of at least one resonator of the filter in FIG. 5 having an inductive portion thereof modified according to the method of the present invention.

Referring now to the drawings, FIG. 1 depicts a single resonator ceramic bandpass filter 100 according to the known prior art. Filter 100 includes a block which is comprised of a dielectric material that is selectively plated with a conformal conductive coating. Filter 100 can be constructed of any suitable dielectric material that has low loss, a high dielectric constant, and a low temperature coefficient of the dielectric constant. In a preferred embodiment, filter 100 is comprised of a ceramic compound including barium oxide, titanium oxide, and zirconium oxide, the electrical characteristics of which are known in the art. Of the many ceramic compounds which may be prepared by various ratios of these three substances, one compound well suited for use in the ceramic filters of the present invention is comprised of the composition 18.5 mole % BaO, 77.0 mole % $TiO_2$ and 4.5 mole % $ZrO_2$ and has a dielectric constant of 40.

Referring to filter 100 of FIG. 1, dielectric block is conformally coated, or plated, with an electrically conductive material, such as copper or silver, with the exceptions of areas 140. As shown plated, block 130 includes a through-hole 101, which extends from the top surface to the bottom surface thereof. Through-hole 101 is also plated with the electrically conductive material. As such, the plated through-hole 101 is essentially a foreshortened coaxial resonator comprised of a short-circuited coaxial transmission line having a length selected for desired filter response characteristics. Input and output signals, respectively, are accommodated via input and output electrodes 124 and 125, respectively. Although block 130 is shown with a single plated through-hole 101, any number of plated through-holes can be utilized depending on the filter response characteristics desired. In addition, RF signals can be coupled to filter 100 by means of connectors instead of coaxial cables 120 and 122, as shown.

The plating of through-hole 101 in filter 100 of FIG. 1 is illustrated more clearly in FIG. 2 by taking a cross-sectional view along lines 2—2 of FIG. 1.

Referring to FIG. 2, conductive plating 204 on the surfaces of dielectric material 202 also covers the cylindrical surfaces of through-hole 201 from the bottom, or base area, 204, to the top surface, with the exception of a circular portion 140 around through-hole 201. This circular portion 140 comprises the capacitive portion of the resonator. Other conductive plating arrangements can be utilized, but this arrangement is the most common in the known art. The base area of the resonator can be better visualized by referring to FIG. 3.

As shown, FIG. 3 illustrates at 300 a bottom perspective view of the ceramic filter of FIGS. 1 and 2, showing through-hole 101 through dielectric block 202 and having conductive plating near the base 204 of the resonator. The conductive plating in proximity to the through-hole 101 is continuous, with no absence of plating, as taught in the known art.

Turning now to FIG. 4A, there is depicted at 400 a bottom perspective view of a resonator which is constructed and arranged according to the present invention. Like numerals are employed for corresponding components wherever applicable. As shown in FIG. 4A, plated through-hole 101 forms a resonator within dielectric block 202 and includes conductive plating around the base 204 of resonator 101. Although the top surface is not shown, it is to be understood that input and output signals may be coupled via one or more electrodes like those shown in FIG. 1, and includes a capacitive region formed by having portions of the plating on the top surface removed or initially absent similar to area 140 of FIG. 1. Resonator 101 also includes a portion of the plating removed at the base of resonator 101, as illustrated at 204B of FIG. 4A. Portion 204B represents the partial absence of plating substantially near the rim of the base of resonator 204 and is best understood by referring to the schematic diagram of FIG. 4B, which depicts the plated through-hole 101 as a distributed inductance. This distributed inductance may be modelled as a series connection of paralleled, lumped inductances, as shown. That is, starting from the open-circuited end corresponding to the region of open area 140 on the top surface, there are paralleled lumped inductances 406A, B, and C which have one terminal thereof coupled to one end of paralleled lumped inductances 404A, B, and C, and ultimately connecting to inductance near the base of the resonator, given by inductances 402A, B. Because paralleling inductors causes a net decrease in inductance, removal of plating (such as represented by disconnected inductance 402B) causes a net increase in inductance which, in turn, causes a resultant lowering of the resonant frequency. It is to be understood that an inductance 402C (not shown), belonging with inductances 402A and 402B, may be included as part of the distributed inductive model. This has not been shown to facilitate clear understanding of the present invention.

In practicing the present tuning method, one performs selective adjustment of the inductive portions of the conformal conductive coating at the base of the resonator, as represented in bottom perspective view of FIG. 4A. This change in inductance then causes a resultant adjusting of the resonant frequency from a first to a second frequency. This selective adjustment may take the form of removing an incremental inductive portion of the plating near the base of the resonator, or may include modifying a pre-existing opening provided during initial application of the conductive coating, as by photomasking techniques. Thus selective adjustment involves forming or modifying a partial opening 204B in the otherwise normally continuous plating at the rim of resonator 101 shown in FIG. 4A.

Tuning the resonator in a subtractive manner is especially desirable since this technique allows realtime, on-line adjustments to be made. Several subtractive tuning processes are suitable, such as abrasive removal of or laser-trimming both the capacitive portion and the inductive portion of the plating for at least one resonator of a ceramic filter. Thus, when selectively removing capacitive portions of the plating (represented by open region 140 of FIGS. 1 and 2) for the resonator during normal forward tuning procedure, the present method also permits tuning in a backward direction by selectively removing inductive portions of the plating (represented by 402B of FIG. 4A), which effectively lowers the resonant frequency. Of course, it is recognized that there are limits to using this method, since trade-offs are involved. That is, the unloaded Q (quality factor) will be seriously degraded if one removes too much plating from the base of a given resonator. However, the method is very effective in providing relatively small changes in the resonant frequency when making incremental changes to the inductive portions of the plating, and this feature is particularly advantageous when fine-tuning one or more resonators in a multi-resonator filter, since the rate of tuning is much smaller relative to the rate of tuning associated with incremental adjustments to the capacitive portions of the plating.

As a result, filters once thought to be rendered useless due to "over-tuning" are able to utilize the "back-tuning" feature for one or more resonators, to shift the resonant frequency from a first frequency which is too high, to a second frequency nearer to or equal to a desired frequency. Moreover, the relatively "slower" rate of tuning change lends greater tuning accuracy to the process by permitting one to "zero-in" on the desired frequency without overshooting it. Thus it should be clear that if the resonator is "over-tuned" by accidentally removing too much of the capacitive portions of the plating, then, by selectively removing inductive portions of the plating at the base of the resonator, one is able to "back-tune" the resonator from a first frequency (which is too high), to a desired (second) frequency by increasing the resonator's inductance and causing a resultant lowering of the frequency.

Furthermore, as stated earlier, the present invention also contemplates in the method that a resonator may be tuned by selectively adjusting or modifying either of the capacitive portions or the inductive portions of a resonator, given a predetermined artwork for the capacitive portion of the resonator, suggested by FIG. 1, and having a predetermined artwork for the base or rim of the resonator, as suggested by FIG. 4A. In such a case, one may then adjust the resonator by selectively adjusting, utilizing an additive process, the capacitive portions and the inductive portions of the conductive coating for the resonator. Adjustment of the resonator is then accomplished by adding conductive paint in the region of capacitive portion 140 nearest resonator 101 depicted in FIG. 1, and selectively adding conductive paint to a part of the base or rim of the resonator (having an initial absence of conductive plating), as represented by region 402B of FIG. 4A. In such a case the frequency adjustment characteristics for selectively adding conductive paint to the capacitive portion and the inductive portion of the resonator would be exactly opposite of that described for the first example of the method of tuning according to the present invention. That is, adding conductive paint to the capacitive portion would cause a resultant lowering of the resonant frequency. Adding conductive paint to a region prescribed at the base or rim of a given resonator lacking conductive plating would cause a resultant increase in the resonant frequency for the given resonator, since this would serve to re-connect part or all of inductance 402B represented in FIG. 4B.

The further usefulness of having bidirectional tuning capability for one or more resonators in an electronic filter having a plurality of resonators will now be discussed by way of several examples which follow.

Figure 5:
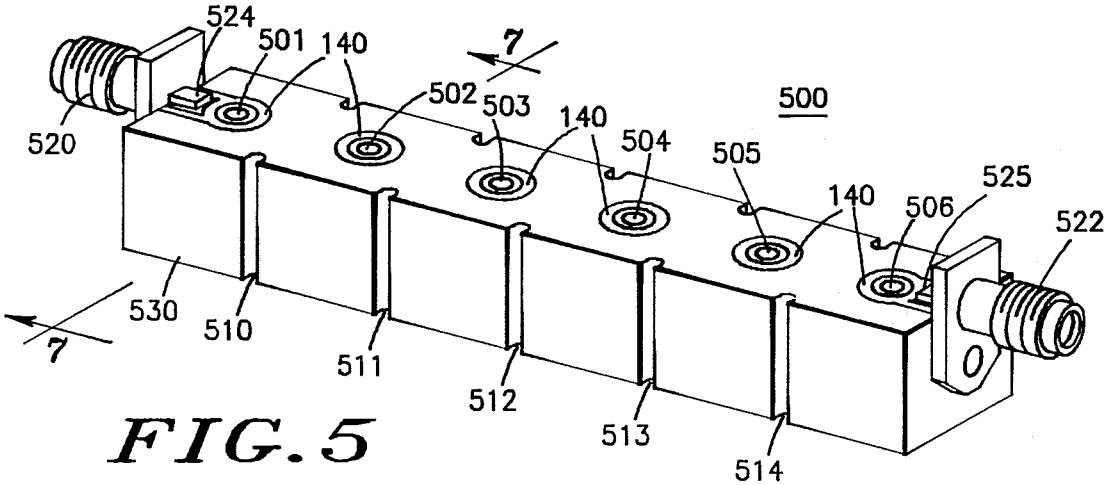
FIG. 5 is an exemplary view of an electronic filter according to the present invention.

Turning now to FIG. 5, an electronic filter having six resonators is depicted at 500, any one of which has the inventive structure and method of tuning described with some particularity in conjunction with FIGS. 4A and 4B. Referring to FIG. 5, a dielectric block of filter 500 is covered or plated with an electrically conductive material, such as silver or copper, with the exception of areas 140. Plated Block 530 includes six holes 501–506, each of which extend from the top surface to the bottom surface thereof. Each of holes 501–506 are likewise plated with an electrically conductive material, and by virtue of the relative proximity to one another and the predetermined arrangement of the top-side plating, each of the plating through-holes 501–506 forms a foreshortened coaxial resonator having a preselected length and capacitive region for achieving a desired filter response characteristic. Input and output electrodes 524–525 are provided for connecting to a suitable RF signal transmission line or coaxial connector 520, 522. Coupling between the coaxial resonators provided by plated holes 501–506 in FIG. 5 is accomplished through the dielectric material and is varied by changing the width of the dielectric block and the distance between adjacent coaxial resonators. The width of the dielectric material between adjacent holes 501–506 can be adjusted in any regular or irregular manner, this example incorporating slots 510–514 having a generally cylindrical shape. A pictorial schematic diagram of the exemplary multi-resonator ceramic filter of FIG. 5 is shown in FIG. 6.

Figure 6:
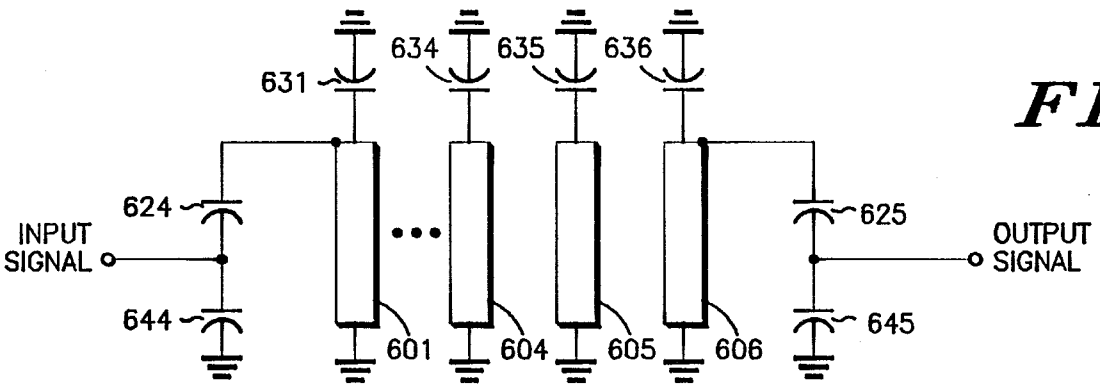
FIG 6. is a schematic diagram representative of the electronic filter depicted in FIG. 5.

Referring to FIG. 6, an equivalent circuit schematic diagram for the ceramic bandpass filter 500 in FIG. 5 is shown having an input signal applied by a connector 520 to input electrode 524 in FIG. 5, which corresponds to the common junction of capacitors 624 and 644 in FIG. 6. Capacitor 644 represents the distributed capacitance through the dielectric block between electrode 524 and the surrounding ground plating. Capacitor 624 represents the distributed capacitance between electrode 524 and the coaxial resonator formed by plated through-hole 501 in FIG. 5. The coaxial resonators provided by plated holes 501–506 in FIG. 5, therefore, correspond to shorted transmission lines 601–606 in FIG. 6. Capacitors 631–636 in FIG. 6 represent the distributed capacitance between the coaxial resonators and the surrounding conformal ground plating, essentially in the open areas 140 which correspond to the capacitive portions of the resonators on the top surface. Such an arrangement represented by the schematic diagram of FIG. 6 and shown pictorally in FIG. 5 is known as a comb-line filter arrangement. For at least one of resonators 501–506 tuned according to the present inventive method (for example resonator 502), a cross sectional view of this resonator taken at lines 7—7 is best seen in FIG. 7.

Referring now to FIG. 7, an inverted cross-sectional view of a resonator within filter 500 of FIG. 5, and corresponding to the bottom perspective view of FIG. 4A, is shown. This resonator has a plated through-hole 502 through dielectric block 202, which has conformal conductive plating 404 thereon. A capacitive region is provided by the essentially circular open area 140 in conductive plating 204. The inductive portion of the conductive plating which has been removed from resonator 502 at the rim or base of the resonator is shown as region 204B.

Figure 8:
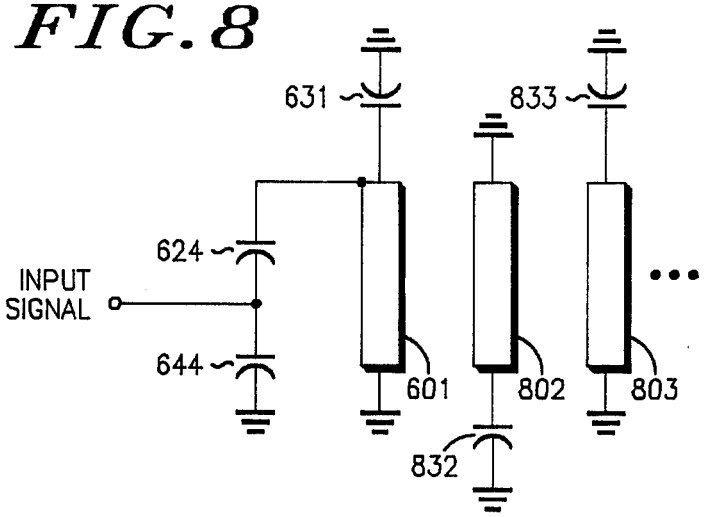
FIG. 8 is a schematic diagram of an alternate embodiment from that shown and represented in FIGS. 5 and 6, respectively.

FIG. 8 shows another common filter structure which lends itself to the particular method of tuning of the present invention. The structure and arrangement of the input signal port and the first resonator is like that of the comb-line filter of FIG. 5, having shorted transmission line 601, distributed capacitance 631, and having input electrode 624 like that in FIG. 6 which corresponds to the common junction of distributed capacitance 624 and 644. However, the next adjacent resonator represented by shorted transmission line 802 and distributed capacitance 832 is inverted, as shown schematically by having the base of the resonator on the top surface (as opposed to the bottom surface like that of first resonator 601). Then, the next resonator 803 with distributed capacitance 833 is arranged like the first resonator, with the ground as shown, and alternating for successive resonators in an interdigital manner.

Figure 9:
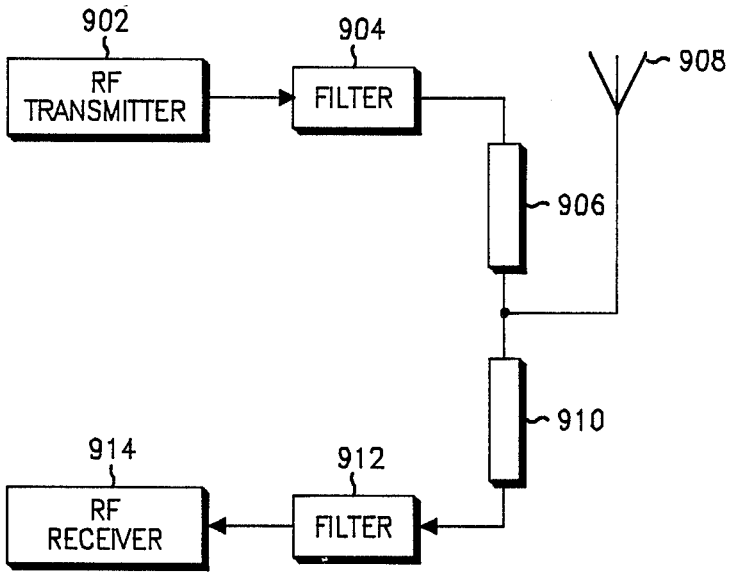
FIG. 9 is a block diagram of a mobile radio incorporating one or more electronic filters having at least one resonator constructed and arranged according to the present invention.

Referring to FIG. 9, there is illustrated one exemplary use of two or more of the inventive ceramic bandpass filters of the present invention intercoupled to provide apparatus that frequency combines or sorts two RF signals into or from a composite RF signal port. Such an application is a mobile radio having an RF transmitter 902 which couples an RF transmit signal therefrom to antenna 908 and which couples a receive signal from antenna 908 to RF receiver 914. The arrangement in FIG. 9 can be advantageously utilized in mobile, portable, and fixed station radios as an antenna duplexer. Filter 904 is one ceramic bandpass filter of the present invention. It includes at least one resonator having the structure and method of tuning according to the present invention, as illustrated in FIGS. 4A, 4B, 5, 6, 7, and 8. The passband of filter 904 is centered about the frequency of the transmit signal from RF transmitter 902, while at the same time greatly attenuating the frequency of the received signal. Transmission line 906 is selected to having an electrical length which maximizes its impedance at the frequency of the received signal.

Likewise, a receive signal from antenna 908 in FIG. 9 is coupled via transmission line 910 to filter 912 and thereafter to RF receiver 914. Filter 914 is also a ceramic bandpass filter of the present invention, having at least one resonator arranged and tuned according to the present method. Its passband is centered about the frequency of the receive signal, while at the same time greatly attenuating the transmit signal. Similarly, the length of transmission line 910 is selected to maximize its impedance at the transmit frequency for further attenuating the transmit signal.

Although filters 904 and 912 have been described generally as having six resonators in a comb-line configuration, such as depicted in FIG. 5, for example, it will be apparent to those skilled in the art that alternate structures for filters 904 and 912 may be utilized, in which the same or a fewer number of resonators are utilized as "poles" and in which one or more "zeroes" are utilized to achieve stronger stopband rejection for either the upper or lower skirt of the passband response curve. Thus, referring to one embodiment of the RF signal duplexing apparatus of FIG. 9, transmit signals may be centered on a passband frequency range of 825 to 845 MHz, with the "zero" configured and tuned to the lowest receive signal at a frequency of 870 MHz. Conversely, filter 912 may be configured to have a passband frequency range for receive signals of 870 to 890 MHz, with a "zero" configured and adjusted to provide a relative maximum amount of attenuation at the highest transmit signal, namely 845 MHz. Such ceramic band pass filters 904 and 912 were of the type shown in FIG. 5. Of course, many variations are possible, but the advantage of including a "zero" is significant, namely with regard to the exemplary frequency ranges just discussed. For example, a 6 pole, 1 zero filter is capable of providing at least 60 dB of attenuation at the respective rejection frequency, while a 6 pole, no-zero filter may only provide 50 dB rejection of the respective out-of-band frequencies previously discussed.

In summary, an improved ceramic bandpass filter structure and method of tuning has been described that provides greater tuning flexibility as well as more precise tuning. As a result, the present invention facilitates automated tuning of a large volume of filters of varying complexity without sacrificing yields. It also minimizes the scrapping of entire filter assemblies heretofore thought to be rendered useless when a select few resonators were "overtuned" during the subtractive tuning process. Such structure and method of tuning is amenable to a plurality of filters which are intercoupled for providing greater selectivity or frequency combining two or more RF signals with respect to a composite RF signal port. Such structure and method of tuning is especially advantageous when tuning and optimizing performance of an antenna duplexer for an assembly having at least two ceramic bandpass filters intercoupled to sort signals to and from an antenna port. In each example the disclosed arrangement and method of tuning is able to overcome the limitations of tuning resonators as described in the known prior art.

Although the arrangement and method of the present invention fully disclose many of the intended advantages, it is understood that various changes and modifications not depicted herein are apparent to those skilled in the art. Therefore, even though the form of the above-described invention is merely a preferred or exemplary embodiment given with practical alternates, further variations may be made in the form, construction, and arrangement of the parts without departing from the scope of the above invention.

We claim:

1. A method for tuning a resonator, formed from a transmission line having a short-circuited end as a base within a dielectric block and including at least one through-hole therein, the dielectric block and the through-hole having a conformal conductive coating that covers essentially the entire surfaces thereof, the method comprising the step of:

removing a portion of the conductive coating near the base of the resonator so as to effect a change in inductance of said resonator.

2. A method for tuning a resonator, formed from a transmission line having a short-circuited end as a base within a dielectric block and including at least one through-hole therein, the dielectric block and the through-hole having a conformal conductive coating that covers essentially the entire surfaces thereof, and the base of the resonator including an area having an initial absence of conductive coating, the method comprising the step of:

adding conductive material to a portion of said area at the base of the resonator, so as to effect a change in inductance for the resonator therein.

3. A method for tuning an electronic filter having at least two resonators, each formed from a transmission line having a short-circuited end as a base within a dielectric block and including at least two through-holes spatially disposed at a predetermined distance from one another, the dielectric block and the through-holes having a conformal conductive coating that covers essentially the entire surfaces thereof, the method comprising the steps of:

(a) removing a portion of said conductive coating near the base of at least one of said resonators in a preestablished tuning sequence, in order to tune said at least one resonator to modify a value of inductance associated with said resonator; and (b) adding to said conformal coating near the base of at least one resonator to modify a value of inductance associated with said resonator;

said steps (a) and (b) providing a change in resonant frequency for attaining the predetermined phase target of each such resonator, thereby providing bidirectional tuning for at least one resonator in the filter.

4. A method for tuning an electronic filter having at least two resonators, each formed from a transmission line having a short-circuited end as a base within a dielectric block and including at least two through-holes spatially disposed at a predetermined distance from one another, the dielectric block and the through-holes having a conformal conductive coating that covers essentially the entire surface thereof, except for an open area around each through-hole at an end opposite that of said base, the method comprising the steps of:

(a) removing a portion of said conductive coating near said open area, for at least one of said resonators in a preestablished tuning sequence, in order to capacitively tune each resonator to a respective predetermined phase target; and (b) removing a portion of the conductive coating near the base of at least one of said resonators.

5. The method according to claim 4, wherein said desired phase accuracy is measured as within 10 degrees of the predetermined phase target for each resonator therein.

6. The method according to claim 4, wherein said step (a) of removing includes removing incremental portions of the conductive coating so as to effect a resultant incremental increase in the resonant frequency of the resonator therein.

7. The method according to claim 4, wherein said step (b) of removing includes removing incremental portions of the conductive coating so as to effect a resultant incremental decrease in the resonant frequency of the resonator therein.

8. The method according to claim 4, further comprising the step of:

(c) repeating either of the above steps a number of times sufficient to incrementally tune at least one of the resonators to a desired accuracy, so as to effect bidirectional tuning for said at least one resonator of the filter.

9. An electronic filter apparatus comprising in combination:

dielectric means for housing an electronic filter having at least two through-holes spatially disposed at a predetermined distance from one another;

conductive coating means, applied conformally to said dielectric means over substantially all outside surfaces as well as each through-hole therein, for forming at least two resonators, each formed from a transmission line which includes a short-circuited end as a base and an open area around each through-hole at an end opposite that of said base, said open area constituting a first end having capacitive reactance thereat, and said base constituting a second end having an associated distributed inductance, said base of at least one of said resonators having a portion of conductive coating near said base in which said conductive coating has been removed to cause the inductance of said at least one resonator to increase relative to the inductance of said at least one resonator prior to said portion being removed.

10. The apparatus according to claim 9, wherein said dielectric means comprises a solid dielectric block having an essentially parallelpiped shape.

11. The apparatus according to claim 9, wherein said conductive coating means comprises a plated metallic material.

12. The apparatus according to claim 9, wherein said conductive coating means comprises silver.

13. The apparatus according to claim 9, wherein said conductive coating means is initially configured to provide a plurality of resonators in an interdigital arrangement.

14. The apparatus according to claim 9, wherein said conductive coating means is initially configured to provide a plurality of resonators in a comb-line arrangement.

15. The apparatus according to claim 9, wherein said conductive coating comprises copper.

16. In a two-way radio, improved electronic filter apparatus comprising in combination:

dielectric means for housing an electronic filter having at least two through-holes spatially disposed at a predetermined distance from one another;

conductive coating means, applied conformally to said dielectric means over substantially all outside surfaces as well as each through-hole therein, for forming at least two resonators, each formed from a transmission line which includes a short-circuited end as a base and an open area around each through-hole at an end opposite that of said base, said open area constituting a first end having capacitive reactance thereat, and said base constituting a second end having an associated distributed inductance, said base of at least one of said resonators having a portion of conductive coating near said base in which said conductive coating has been removed to cause the inductance of said at least one resonator to increase relative to the inductance of said at least one resonator prior to said portion being removed.

17. The apparatus according to claim 19, wherein said conductive coating means includes conductive plating having portions removed from near said first end, as well as portions removed from near said second end of said at least one resonator therein.

18. The apparatus according to claim 16, wherein said dielectric means includes at least two electronic filters intercoupled to provide a plurality of passband responses.

19. The apparatus according to claim 18, wherein said dielectric means includes two electronic filters intercoupled as a duplexer to provide a combined transmit frequency passband and a receive frequency passband response to a common antenna port.

* * * * *

UNITED STATES PATENT AND TRADEMARK OFFICE

CERTIFICATE OF CORRECTION

PATENT NO. : 4,800,348

DATED : January 24, 1989

INVENTOR(S) : Rosar et al.

It is certified that error appears in the above-identified patent and that said Letters Patent is hereby corrected as shown below:

In column 10, line 55, please change "19" to --16--.

Signed and Sealed this

Twenty-first Day of November, 1989

*Attest:*

JEFFREY M. SAMUELS

*Attesting Officer*

*Acting Commissioner of Patents and Trademarks*